United States Patent [19]

Kataoka

[11] Patent Number: 4,651,694

[45] Date of Patent: Mar. 24, 1987

[54] SYSTEM FOR CONTROLLING THE IDLE SPEED OF AN AUTOMOTIVE ENGINE

[75] Inventor: Ryuji Kataoka, Mitaka, Japan

[73] Assignee: Fuji Jukogyo Kabushiki Kaisha, Tokyo, Japan

[21] Appl. No.: 801,975

[22] Filed: Nov. 26, 1985

[30] Foreign Application Priority Data

Nov. 28, 1984 [JP] Japan ..... 59-252271

[51] Int. Cl.[4] ..... F02D 11/10

[52] U.S. Cl. ..... 123/339; 123/179 G

[58] Field of Search ..... 123/339, 340, 179 L, 123/179 G

[56] References Cited

U.S. PATENT DOCUMENTS 4,444,168 4/1984 Matsumura ..... 123/339

4,469,064 9/1984 Manaka ..... 123/339

*Primary Examiner*—Ronald B. Cox

*Attorney, Agent, or Firm*—Martin A. Farber

[57] ABSTRACT

A system having two look-up tables, one of which is for high idle speed in a first state of a motor vehicle after starting the engine thereof and before depression of the accelerator pedal, and the other of which is for low idle speed in a second state after the accelerator pedal is depressed. The idle speed in the first state is set faster than the second state so as to provide fast idling.

5 Claims, 4 Drawing Figures

| COOLANT TEMPERATURE | -20° | -10° | 0° | 5° | 10° |
|---|---|---|---|---|---|
| NE | --- | --- | --- | --- | --- |
| NR | --- | --- | --- | --- | --- |

SYSTEM FOR CONTROLLING THE IDLE SPEED OF AN AUTOMOTIVE ENGINE

BACKGROUND OF THE INVENTION

The present invention relates to a system for controlling the idle speed of an automotive engine.

A conventional idle speed control system with a microcomputer is adapted to control the idle speed to a desired idle speed stored in a look-up table in accordance with the temperature of the coolant of the engine. The desired idle speed is set at a relatively high value in order to achieve fast idle warm up. However, if a motor vehicle is started at such a high idle speed during the warm up, it is difficult to slowly and moderately start the motor vehicle. Furthermore high idle speed causes loud exhaust noises.

SUMMARY OF THE INVENTION

The object of the present invention is to provide a system which controls the idle speed of an automotive engine at a high idle speed upon starting the engine, and at a low idle speed when a driver depresses the accelerator pedal of the vehicle at high idle speed, whereby high idle speed can be changed to a low idle speed engine as desired.

The above and other objects and features of this invention will become understood from the following description with reference to the accompanying drawings.

DETAILED DESCRIPTION OF THE PREFERRED EMBODIMENT

Figure 1:
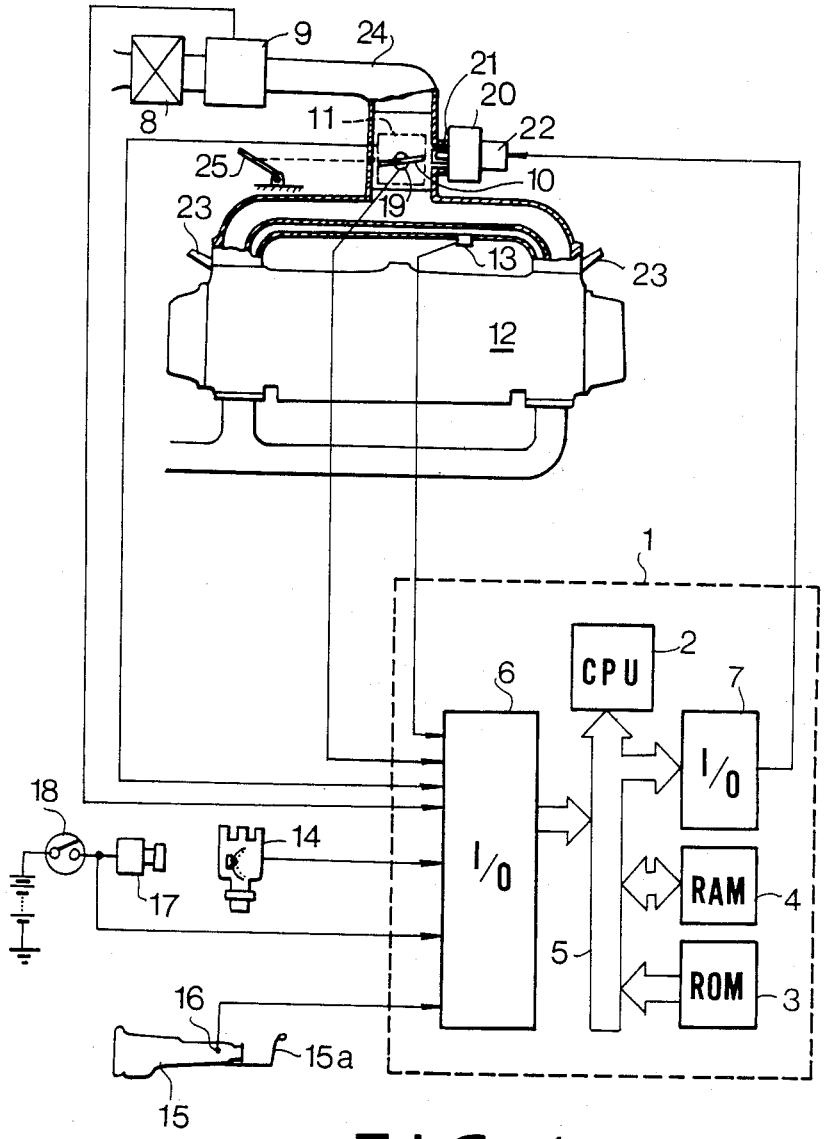
FIG. 1 is a schematic view showing a system according to the present invention.

Referring to FIG. 1, an electronic control unit (computer) 1 comprises a CPU 2, ROM 3, RAM 4, input interface 6, output interface 7 and BUS 5. An automotive engine 12 is provided with a fuel injection system with fuel injectors 23 and has various sensors, such as an idle switch 11 producing an idle signal when a throttle valve 10 provided in an intake passage 24 for the engine is at an idle position, a mass air flow meter 9 downstream of an air cleaner 8, a coolant temperature sensor 13, an engine speed sensor 14, a throttle position sensor 19, and a neutral switch 16 provided on a transmission 15 which produces a neutral signal when a gear select lever 15*a* is at neutral position. The engine further has a starter switch 18 for a starter 17. An air bypass 21 is provided around the throttle valve 10. An idle speed control valve 20, for example a solenoid operated valve, is provided for controlling the air flow passing through the bypass 21.

Figures 2, 3A:
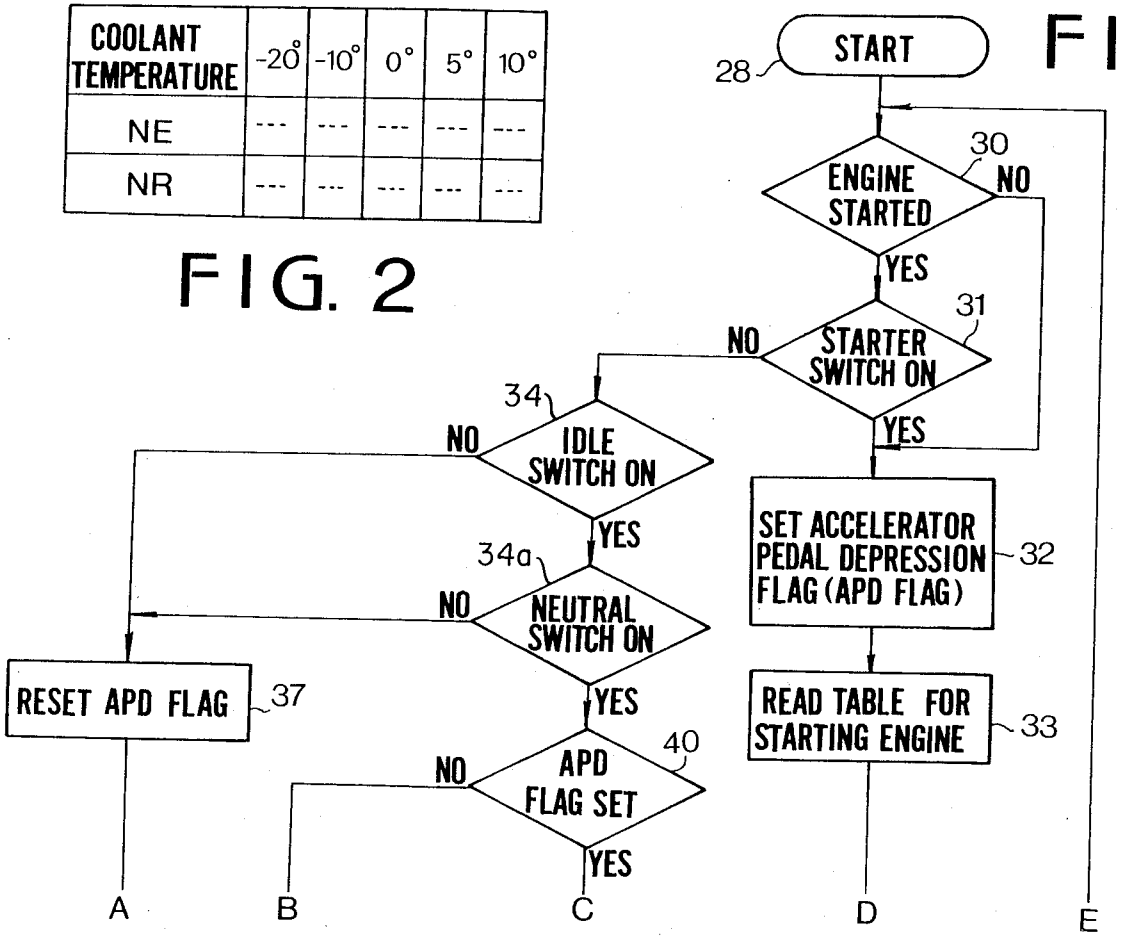
FIG. 2 shows look-up tables used for controlling the idle speed of an automotive engine.
FIGS. 3*a* and 3*b* are flowcharts showing the operation of the system.

Output signals of the mass air flow meter 9, idle switch 11, throttle position sensor 19, coolant temperature sensor 13, engine speed sensor 14, neutral switch 16, and starter switch 18 are applied to the input interface 6. Idle operation is detected by the signal of the idle switch 11 or the neutral switch 16. The ROM 3 stores two kinds of look-up tables one of which is for high idle speed before depression of an accelerator pedal 25 (FIG. 1) which is operatively connected to the throttle valve 10 and the other is for low idle speed after depression of the accelerator pedal. These idle speeds change in dependency on coolant temperature. FIG. 2 shows a look-up table (NE) for desired high idle speed and a look-up table (NR) for desired low idle speed.

In order to control idle speed, the control unit determines whether the accelerator pedal is depressed and produces an output signal. The output signal is applied to an actuator 22 (a solenoid) of the idle speed control valve 20 so as to control the idle speed in accordance with conditions of the engine.

Figure 3B:
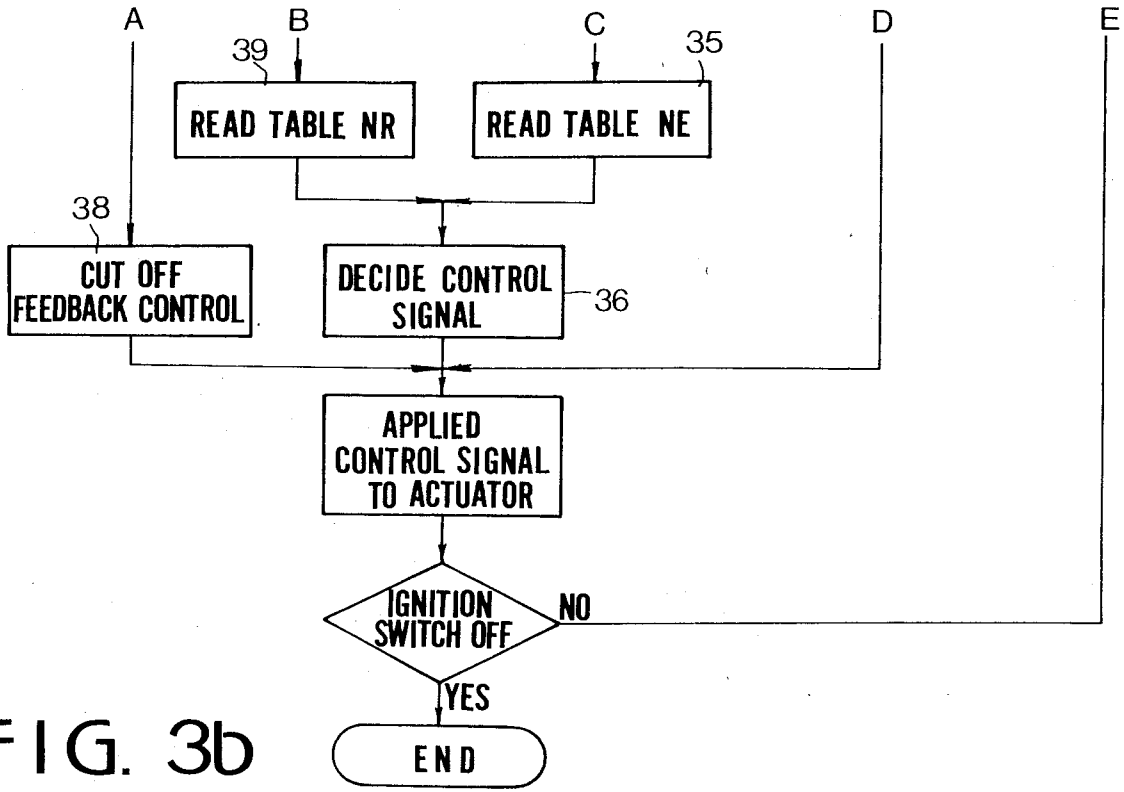

The operation of the system is described hereinafter with reference to FIGS. 3*a* and 3*b*. When the engine is first energized by closure of an ignition switch (not shown), the computer program is initiated at a point 28 and then proceeds to a step 30. At step 30, if the engine is not started at the first program, namely the engine speed does not reach a predetermined speed, an accelerator pedal depression flag is set at step 32 and a control value for operating the actuator of the control valve 20 is read out from another look-up table (not shown) for starting the engine at a step 33.

If the engine is started and the starter switch 18 is OFF, the program proceeds to step 34 from step 31. When the idle switch 11 is ON the program goes to step 34*a* and when the neutral switch 16 is also ON and when the pedal depression flag is set, the desired high idle speed is read out from the table NE at a step 35. The computer operates to determine the control signal for the actuator at step 36 so as to control the actual idle speed detected by the engine speed sensor 14 to the desired high idle speed by feeding back the engine speed. The control signal is applied to the actuator 22 of the control valve 20 thereby controlling the idle speed to the desired high idle speed.

When the idle switch 11 or the neutral switch 16 is OFF, which means that the vehicle is being started or has been started, the pedal depression flag is reset at step 37. Accordingly, the program proceeds to step 38. On the other hand, if the pedal depression flag is reset, at step 40 the program goes to step 39. At the step 39, the idle speed for the low idle state is read out from the table NR. Accordingly, the desired low idle speed is set to a lower speed than the high idle speed. On the other hand at the step 38, the feedback control of idle speed is cut off.

In accordance with the present invention, the engine is fast quickly warmed up by fast (high) idle before depression of the accelerator pedal, and high idle speed can be changed to low idle speed by depression of the accelerator pedal.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for controlling the idle speed of an engine for a vehicle, comprising:

means for producing an engine starting signal when the engine is not started;

means including an engine starter switch for producing a starter signal when the starter switch is on when the engine is started and respectively a start signal when the starter switch is off when the engine is started;

setting means responsive to the engine starting signal or the starter signal for setting a flag;

sensing means for detecting idle operation of the engine for producing an idle signal;

an actuator for controlling the speed of the engine;

first means responsive to said start signal, to the idle signal, and to existence of the flag for producing a first signal;

resetting means responsive to the start signal and to nonexistence of the idle signal for resetting the flag to nonexistence of the flag;

second means responsive to the start signal, to the idle signal and to nonexistence of the flag at any vehicle speed for producing a second signal;

a first look-up table storing data for high idle speed;

a second look-up table storing data for low idle speed;

third means responsive to the first signal for reading out the data from the first look-up table and for actuating the actuator for controlling the engine speed in accordance with the data; and fourth means responsive to the second signal for reading out other data from the second look-up table and for actuating the actuator for controlling the engine speed in accordance with the other data.

2. The system as set forth in claim 1, further comprising:

means for sensing neutral position of a gear select lever of a transmission of the vehicle for producing a neutral signal in the neutral position of the gear select lever when said idle signal exists, and respectively, for producing a shifting signal when the gear select lever is not in the neutral position when said idle signal exists, the transmission being operatively connected to the engine and wheels of the vehicle, said resetting means being responsive to said shifting signal for resetting the flag to nonexistence of the flag;

said first means produces said first signal only if said neutral signal also exists;

said second means produces said second signal only if said neutral signal also exists.

3. The system as set forth in claim 2, wherein said means for sensing neutral position includes a neutral switch.

4. A system for controlling the idle speed of an engine for a vehicle, comprising setting means for setting a flag when the engine does not start or an engine start switch is on when the engine is started;

sensing means for detecting idle operation of the engine for producing an idle signal;

an actuator for controlling the speed of the engine;

first means responsive to the idle signal, and to existence of the flag for producing a first signal;

resetting means responsive to nonexistence of the idle signal when the engine is started for resetting the flag to nonexistence of the flag;

second means responsive to the idle signal and to nonexistence of the flag at any vehicle speed for producing a second signal;

a first look-up table storing data for high idle speed;

a second look-up table storing data for low idle speed;

third means responsive to the first signal for reading out the data from the first look-up table and for actuating the actuator for controlling the engine speed in accordance with the data; and fourth means responsive to the second signal for reading out other data from the second look-up table and for actuating the actuator for controlling the engine speed in accordance with the other data.

5. The system according to claim 1 wherein the actuator is provided for operating a control valve provided in a bypass of the throttle valve.

* * * * *